US005534478A

United States Patent [19]

Bowman et al.

[11] Patent Number: 5,534,478

[45] **Date of Patent: *Jul. 9, 1996**

[54] THERMAL DYE TRANSFER SYSTEM WITH POLYESTER IONOMER RECEIVER

[75] Inventors: Wayne A. Bowman, Walworth; Leslie Shuttleworth; Helmut Weber, both of Webster, all of N.Y.

[73] Assignee: Eastman Kodak Company, Rochester, N.Y.

[ * ] Notice: The term of this patent shall not extend beyond the expiration date of Pat. No. 5,317,001.

[21] Appl. No.: 469,132

[22] Filed: Jun. 6, 1995

[51] Int. Cl.[6] ..... B41M 5/035; B41M 5/38

[52] U.S. Cl. ..... 503/227; 428/195; 428/480; 428/913; 428/914

[58] Field of Search ..... 8/471; 428/195, 428/480, 913, 914; 503/227

[56] References Cited

U.S. PATENT DOCUMENTS

| | | | |
|---|---|---|---|
| 4,880,769 | 11/1989 | Dix et al. | 503/227 |
| 5,317,001 | 5/1994 | Daly et al. | 503/227 |
| 5,324,705 | 6/1994 | Ito | 503/227 |

*Primary Examiner*—B. Hamilton Hess
*Attorney, Agent, or Firm*—Harold E. Cole

[57] ABSTRACT

A thermal dye transfer assemblage comprising:

(a) a dye-donor element comprising a support having thereon a dye layer comprising a dye dispersed in a polymeric binder, the dye being a cationic dye or a deprotonated cationic dye which is capable of being reprotonated to a cationic dye having a N—H group which is part of a conjugated system, and (b) a dye-receiving element comprising a support having thereon a polymeric dye image-receiving layer, the dye-receiving element being in a superposed relationship with the dye-donor element so that the dye layer is in contact with the dye image-receiving layer, the dye image-receiving layer comprising a polyester ionomer comprising a polyester backbone containing units of a sulfonic acid or a sulfonimide or their salts, with the proviso that when the dye is a deprotonated cationic dye which is capable of being reprotonated to a cationic dye having a N—H group which is part of a conjugated system, the dye image-receiving layer comprises a polyester ionomer comprising a polyester backbone containing units of a sulfonic acid or a sulfonimide.

20 Claims, No Drawings

THERMAL DYE TRANSFER SYSTEM WITH POLYESTER IONOMER RECEIVER

This invention relates to a thermal dye transfer receiver element of a thermal dye transfer system and, more particularly, to a polymeric dye image-receiving layer comprising a polyester ionomer for cationic or deprotonated cationic dyes transferred to the receiver from a suitable donor.

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to one of the cyan, magenta or yellow signals, and the process is then repeated for the other two colors. A color hard copy is thus obtained which corresponds to the original picture viewed on a screen. Further details of this process and an apparatus for carrying it out are contained in U.S. Pat. No. 4,621,271, the disclosure of which is hereby incorporated by reference.

Dyes for thermal dye transfer imaging should have bright hue, good solubility in coating solvents, good transfer efficiency and good light stability. A dye receiver polymer should have good affinity for the dye and provide a stable (to heat and light) environment for the dye after transfer. In particular, the transferred dye image should be resistant to damage caused by handling, or contact with chemicals or other surfaces such as the back of other thermal prints, adhesive tape, and plastic folders, generally referred to as "retransfer".

Commonly-used dyes are nonionic in character because of the easy thermal transfer achievable with this type of compound. The dye-receiver layer usually comprises an organic polymer with polar groups to act as a mordant for the dyes transferred to it. A disadvantage of such a system is that since the dyes are designed to be mobile within the receiver polymer matrix, the prints generated can suffer from dye migration over time.

A number of attempts have been made to overcome the dye migration problem which usually involves creating some kind of bond between the transferred dye and the polymer of the dye image-receiving layer. One such approach involves the transfer of a cationic dye to an anionic dye-receiving layer, thereby forming an electrostatic bond between the two.

U.S. Pat. No. 5,324,705 relates to the use of acidic resin receivers such as vinylidene chloride/acrylonitrile copolymers for use with modified cationic dyes where the counterion has been exchanged for a more oleophilic anion. There is no disclosure in this patent of polyester ionomer receivers that can be used with a cationic dye or a deprotonated cationic dye which is capable of being reprotonated to a cationic dye.

U.S. Pat. No. 4,880,769 describes the thermal transfer of a neutral, deprotonated form of a cationic dye to a receiver element. The receiver element is described as being a coated paper, in particular organic or inorganic materials having an "acid-modified coating". The inorganic materials described are materials such as an acidic clay-coated paper. The organic materials described are "acid-modified polyacrylonitrile, condensation products based on phenol/formaldehyde, certain salicylic acid derivatives and acid-modified polyesters, the latter being preferred." However, the way in which the "acid-modified polyester" is obtained is that an image is transferred to a polyester-coated paper, and then the paper is treated with acidic vapor to reprotonate the dye on the paper.

There is a problem with using this technique of treating polymeric-coated papers with acidic vapors in that this additional step is corrosive to the equipment employed and is a safety hazard to operators. There is also a problem with such a post treatment step to provide an acidic counterion for the cationic dye in that the dye/counterion complex is mobile, and can be retransferred to unwanted surfaces.

It is an object of this invention to provide a thermal dye transfer system employing a dye-receiver having a polyester dye image-receiving layer containing acid groups or their salts without having to use a post-treatment fuming step with acidic vapors. It is another object of this invention to provide a thermal dye transfer system employing a dye-receiver having a polyester dye image-receiving layer containing acid groups or their salts which upon transfer of the dye forms a dye/counterion complex which is substantially immobile, which would reduce the tendency to retransfer to unwanted surfaces. It is another object of this invention to provide a thermal dye transfer system having a polyester dye image-receiving layer containing acid groups or their salts which has improved stability to light.

This and other objects are achieved in accordance with this invention which relates to a thermal dye transfer assemblage comprising:

(a) a dye-donor element comprising a support having thereon a dye layer comprising a dye dispersed in a polymeric binder, the dye being a cationic dye or a deprotonated cationic dye which is capable of being reprotonated to a cationic dye having a N—H group which is part of a conjugated system, and (b) a dye-receiving element comprising a support having thereon a polymeric dye image-receiving layer, the dye-receiving element being in a superposed relationship with the dye-donor element so that the dye layer is in contact with the dye image-receiving layer, the dye image-receiving layer comprising a polyester ionomer comprising a polyester backbone containing units of a sulfonic acid or a sulfonimide or their salts, with the proviso that when the dye is a deprotonated cationic dye which is capable of being reprotonated to a cationic dye having a N—H group which is part of a conjugated system, the dye image-receiving layer comprises a polyester ionomer comprising a polyester backbone containing units of a sulfonic acid or a sulfonimide.

In one embodiment of the invention, the polyester ionomer has functional acid or sulfonimide groups as part of a polyester polymer chain and acts as a matrix for a deprotonated dye. This free acid form of the polyester ionomer will concurrently cause reprotonation and regeneration of a parent cationic dye without the need of any additional process step.

In another embodiment of the invention which uses a cationic dye in the dye-donor element, the polyester ionomer has functional acid or sulfonimide groups or their salts, as part of a polyester polymer chain, and acts as a matrix for the dye.

In a preferred embodiment of the invention, polyester ionomers polymers which are useful are based on the AQ polyester ionomers available commercially from Eastman Chemical Company. These polymers have a polyester backbone which contains isophthalic acid units containing sulfonic acid sodium salt groups.

The commercially available AQ-29 and AQ-55 salt forms of the polyester ionomer have been shown to be effective as a receiving layer for cationic dyes. The free acid forms of AQ-29 and AQ-55 have also been found to be effective in receiving layers for both cationic dyes and deprotonated cationic dyes which are subsequently reprotonated to give the cationic dye.

The free acid form or salt form of these polymers has the formula:

$$\cancel{[A][B][D]}$$

wherein:

A represents a diol component which comprises 100 mole % of recurring units derived from one or more diols having the structure $-OR_1O-$ or

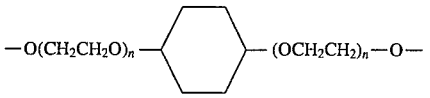

where n=1–4 and $R_1$ represents an alkylene group of 1 to about 16 carbon atoms, a cycloalkylene group of about 6 to about 20 carbon atoms, a cyclobisalkylene group of about 8 to about 20 carbon atoms, or an arylene group of about 6 to about 12 carbon atoms;

B represents an acid component which comprises 8 to 30 mole % of recurring units derived from one or more dicarboxylic acids having the structure

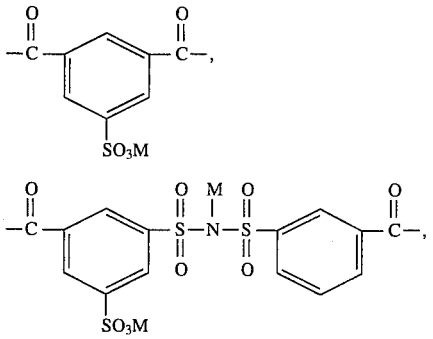

-continued

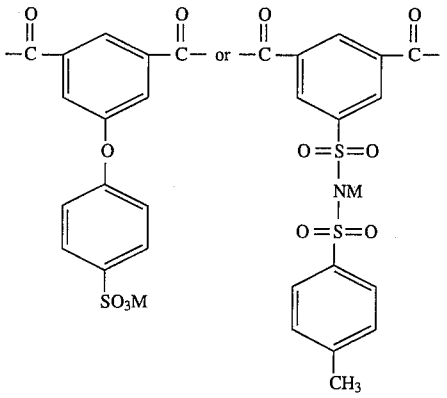

where M=H, Na, K or $NH_4$; and

D represents an acid component which comprises 70 to 92 mole % of recurring units derived from one or more dicarboxylic acids having the structure

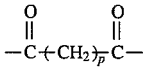

where p=2–10,

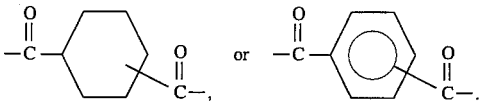

Examples of the free acid form of polymers useful in the invention include the following:

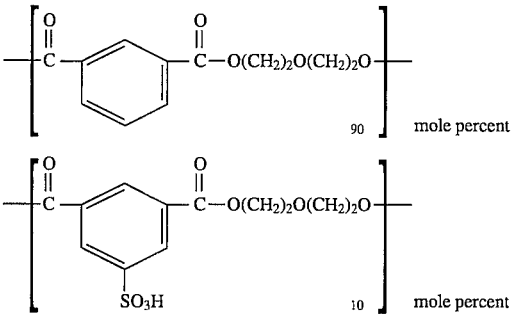

Polymer 1

-continued

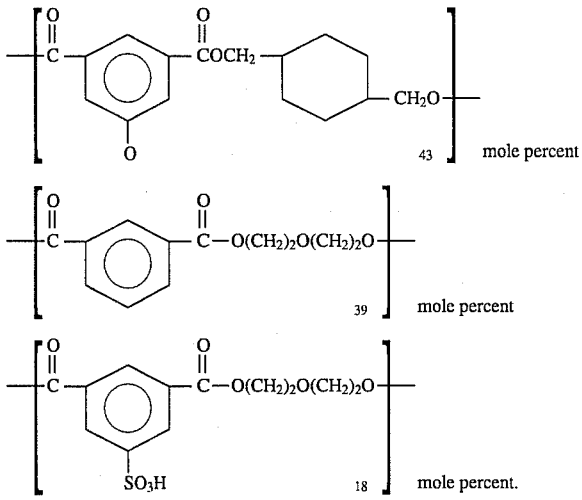

Polymer 2

An example of the salt form of these polymers is an acid salt of Polymer 1 wherein $SO_3H$ is $SO_3Na$, hereinafter known as Polymer 3.

The polyester ionomer polymer in the dye image-receiving layer may be present in any amount which is effective for its intended purpose. In general, good results have been obtained at a concentration of from about 0.5 to about 10 $g/m^2$. The polymers may be coated from organic solvents or water, if desired.

In one embodiment of the invention, a deprotonated cationic dye is employed which is capable of being reprotonated to a cationic dye having a N—H group which is part of a conjugated system has the following equilibrium structure:

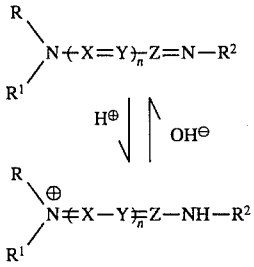

wherein:

X, Y and Z form a conjugated link between nitrogen atoms selected from CH, C-alkyl, N, or a combination thereof, the conjugated link optionally forming part of an aromatic or heterocyclic ring;

R represents a substituted or unsubstituted alkyl group from about 1 to about 10 carbon atoms;

$R^1$ and $R^2$ each individually represents substituted or unsubstituted phenyl or a substituted or unsubstituted alkyl group from about 1 to about 10 carbon atoms; and n is 0 to 11.

The following dyes may be used in accordance with the invention, which also have listed the absorption maxima of the deprotonated and protonated species, with the values for the latter shown in parentheses:

Dye 1

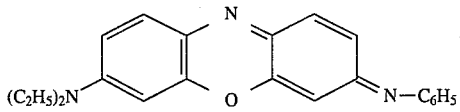

λmax 556 nm (641 nm)
magenta (cyan)

Dye2

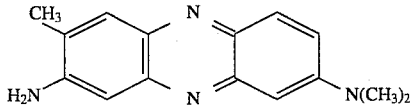

λmax 459 nm (536 nm)
yellow (magenta)

Dye 3

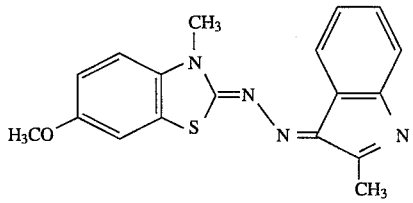

λmax 459 nm (522 nm)
yellow (magenta)

Dye 4

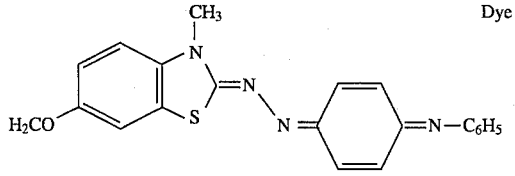

λmax 503 nm (621 nm)
red (blue)

Dye 5

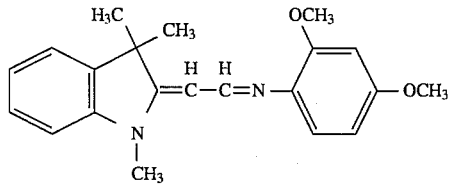

λmax 379 nm (405 nm)
yellow (yellow)

-continued

Dye 6

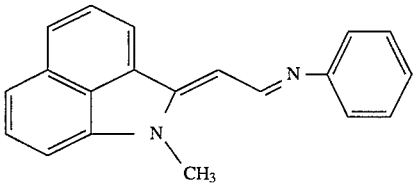

λmax 479 nm (513 nm)
yellow (magenta

Dye 7

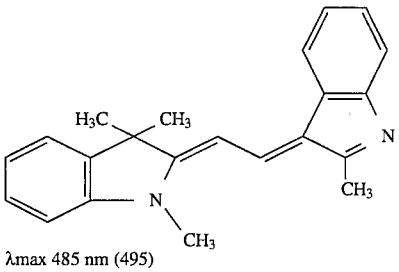

λmax 485 nm (495)
oramge (orange)

Dye 8

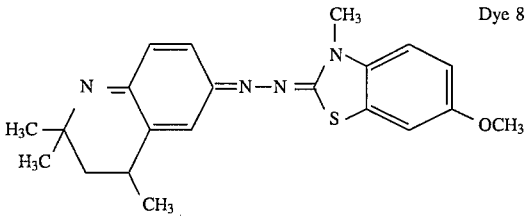

λmax 472 nm (601)
orange (blue)

Dye 9

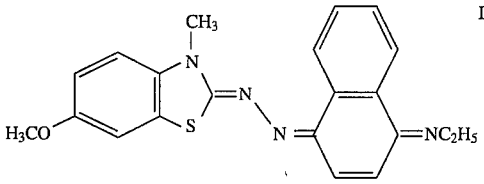

λmax 469 nm (618)
yellow (blue)

In another embodiment of the invention, cationic dyes are employed having the following formula:

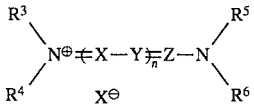

wherein:

X, Y and Z form a conjugated link between nitrogen atoms selected from CH, C-alkyl, N, or a combination thereof, the conjugated link optionally forming part of an aromatic or heterocyclic ring;

$R^3$ represents a substituted or unsubstituted alkyl group from about 1 to about 10 carbon atoms;

$R^4$, $R^5$ and $R^6$ each individually represents hydrogen, substituted or unsubstituted phenyl or a substituted or unsubstituted alkyl group from about 1 to about 10 carbon atoms;

n is 0 to 11; and $X^-$ represents Cl, $HSO_4.ZnSO_4$, $BF_4$, I, $R^7CO_2$, $R^7SO_3$, $R^7C_6H_4SO_3$ or $R^7OSO_3$, where $R^7$ represents a substituted or unsubstituted alkyl group from about 1 to about 18 carbon atoms.

Cationic dyes according to the above formula are disclosed in U.S. Pat. Nos. 4,880,769 and 4,137,042, and in K. Venkataraman ed., *The Chemistry of Synthetic Dyes,* Vol. IV, p. 161, Academic Press, 1971, the disclosures of which are hereby incorporated by reference.

The following cationic dyes are useful in the invention:

Dye 10

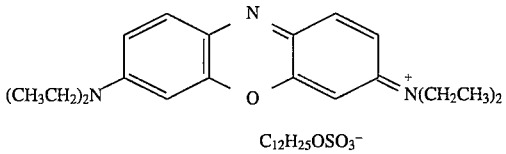

$C_{12}H_{25}OSO_3^-$

Dye 11

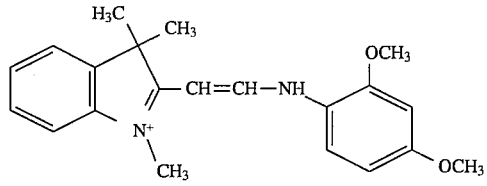

$C_{12}H_{25}OSO_3^-$

The support for the dye-receiving element employed in the invention may be transparent or reflective, and may comprise a polymeric, a synthetic paper, or a cellulosic paper support, or laminates thereof. Examples of transparent supports include films of poly(ether sulfone)s, poly(ethylene naphthalate), polyimides, cellulose esters such as cellulose acetate, poly(vinyl alcohol-co-acetal)s, and poly(ethylene terephthalate). The support may be employed at any desired thickness, usually from about 10 μm to 1000 μm. Additional polymeric layers may be present between the support and the dye image-receiving layer. For example, there may be employed a polyolefin such as polyethylene or polypropylene. White pigments such as titanium dioxide, zinc oxide, etc., may be added to the polymeric layer to provide reflectivity. In addition, a subbing layer may be used over this polymeric layer in order to improve adhesion to the dye image-receiving layer. Such subbing layers are disclosed in U.S. Pat. Nos. 4,748,150, 4,965,238, 4,965,239, and 4,965241, the disclosures of which are incorporated by reference. The receiver element may also include a backing layer such as those disclosed in U.S. Pat. Nos. 5,011,814 and 5,096,875, the disclosures of which are incorporated by reference. In a preferred embodiment of the invention, the support comprises a microvoided thermoplastic core layer coated with thermoplastic surface layers as described in U.S. Pat. No. 5,244,861, the disclosure of which is hereby incorporated by reference.

Resistance to sticking during thermal printing may be enhanced by the addition of release agents to the dye-receiving layer or to an overcoat layer, such as silicone-based compounds, as is conventional in the art.

Dye-donor elements that are used with the dye-receiving element of the invention conventionally comprise a support having thereon a dye layer containing the dyes as described above dispersed in a polymeric binder such as a cellulose derivative, e.g., cellulose acetate hydrogen phthalate, cellulose acetate, cellulose acetate propionate, cellulose acetate butyrate, cellulose triacetate, or any of the materials described in U.S. Pat. No. 4,700,207; or a poly(vinyl acetal) such as poly(vinyl alcohol-co-butyral). The binder may be used at a coverage of from about 0.1 to about 5 $g/m^2$.

As noted above, dye-donor elements are used to form a dye transfer image. Such a process comprises imagewise heating a dye-donor element and transferring a dye image to a dye-receiving element as described above to form the dye transfer image.

In a preferred embodiment of the invention, a dye-donor element is employed which comprises a poly(ethylene terephthalate) support coated with sequential repeating areas of cyan, magenta and yellow dyes as described above, and the dye transfer steps are sequentially performed for each color to obtain a three-color dye transfer image. Of course, when the process is only performed for a single color, then a monochrome dye transfer image is obtained.

Thermal print heads which can be used to transfer dye from dye-donor elements to the receiving elements of the invention are available commercially. There can be employed, for example, a Fujitsu Thermal Head (FTP-040 MCS001), a TDK Thermal Head F415 HH7-1089 or a Rohm Thermal Head KE 2008-F3. Alternatively, other known sources of energy for thermal dye transfer may be used, such as lasers.

When a three-color image is to be obtained, the assemblage described above is formed on three occasions during the time when heat is applied by the thermal printing head. After the first dye is transferred, the elements are peeled apart. A second dye-donor element (or another area of the donor element with a different dye area) is then brought in register with the dye-receiving element and the process repeated. The third color is obtained in the same manner. After thermal dye transfer, the dye image-receiving layer contains a thermally-transferred dye image.

The following examples are provided to further illustrate the invention.

EXAMPLE 1

Preparation of Polyester Ionomer Free Acid (Polymer 1)

AQ-29 (Eastman Chemical Co.) (a 30% aqueous solution of a polyester ionomer containing sodium sulfonate groups) (330 g) was stirred with 100 g of Dowex® 50w-8x acid exchange resin (Dow Chemical Co.) for 16 hours and then filtered to remove the ion exchange resin. The solution contained 12.7% solids.

EXAMPLE 2

Preparation of Polyester Ionomer Free Acid (Polymer 2)

AQ-55 (Eastman Chemical Co.) (a 33% aqueous solution of a polyester ionomer containing sodium sulfonate groups) (200 g) was stirred with 100 g of Dowex® 50w-8x acid ion exchange resin for 24 hours and then filtered to remove the ion exchange resin. The solution contained 15.8% solids,

EXAMPLE 3

Preparation of Control Polymer C-2 poly(styrene-co-butyl methacrylate-co-methacrylic acid-co-2-acrylamido-2-methyl-propanesulfonic acid) (27.1/63.3/5/4.6 by wt.)

To a 1 L 3-necked flask equipped with a stirrer and condenser were added 300 ml of degassed distilled water, 2 ml of 30% Triton® 770 (Rohm & Hass Co.) 1.00 g of potassium persulfate and 0.33 g of sodium metabisulfite. The flask was placed in a 80° C. bath and the contents of an addition flask containing 100 ml of degassed distilled water, 2 ml of 30% Triton 770, 27.1 g of styrene, 63.3 g of butyl methacrylate, 5 g of methacrylic acid, and 4.6 g of 2-acrylamido-2-methyl-propanesulfonic acid was added over a period of 40 minutes. The contents was stirred at 80° C. under nitrogen for 2 hours. The resulting latex was cooled and contained 18.1% solids.

The following Control Polymer C-1 was prepared in a similar manner to C-2 above:

Control Polymer C-1:

poly(butyl methacrylate-co-methacrylic acid- co-2-acrylamido-2-methyl-propanesulfonic acid) (80.4/15.1/4.5 by wt.)

Control Polymer C-3:

poly(vinylidene chloride-co-acrylonitrile) (80/20 by wt.) available from Aldrich Co.

EXAMPLE 4

Preparation of Control Polymer C-4

Poly(butyl acrylate-co-2-acrylamido-2-methyl-propanesulfonic acid) 75/25 wt. %.

To a 1-L three-necked flask equipped with a stirrer and condenser were added 400 g of degassed methanol, 75 g of butyl acrylate, 25 g of 2-acrylamido-2-methyl-propanesulfonic acid and 0.50 g of 2,2'-azobis(methylpropionitrile). The solution was placed in a 60° C. bath and stirred under nitrogen for 16 hours to give a clear, viscous solution. The solution was cooled to 25° C. and contained 20% solids.

The following Control Polymer C-5 was prepared in a similar manner to C-4 above:

Control Polymer C-5:

poly(butyl acrylate-co-2-acrylamido-2-methyl-propanesulfonic acid) Na salt

EXAMPLE 5

Dye-donor elements were prepared by coating on a 6 μm poly(ethylene terephthalate) support:

1) a subbing layer of Tyzor TBT®, a titanium tetrabutoxide, (DuPont Company) (0.16 g/m$^2$) coated from 1-butanol; and
2) a dye layer containing dyes 1, 5 and 9–11 of the invention, and FC-431® fluorocarbon surfactant (3M Company) (0.01 g/m$^2$) in a Butvar® 76 poly(vinyl butyral) binder, (Monsanto Company) coated from a tetrahydrofuran and cyclopentanone solvent mixture (95:5).

Details of dye and binder laydowns are tabulated in Table 1 below.

On the back side of the dye-donor element was coated:

1) a subbing layer of Tyzor TBT®, a titanium tetrabutoxide, (DuPont Company) (0.16 g/m$^2$) coated from 1-butanol; and
2) a slipping layer of Emralon 329® (Acheson Colloids Co.), a dry film lubricant of poly(tetrafluoroethylene) particles in a cellulose nitrate resin binder (0.54 g/m$^2$) and S-nauba micronized carnauba wax (0.1016 g/m$^2$) coated from a n-propyl acetate, toluene, isopropyl alcohol and n-butyl alcohol solvent mixture.

TABLE 1

| Dye Donor Element with Dye # | Dye Laydown (g/m$^2$) | Binder Laydown (g/m$^2$) |
|---|---|---|
| 1 | 0.15 | 0.23 |
| 5 | 0.27 | 0.36 |
| 9 | 0.20 | 0.29 |
| 10 | 0.27 | 0.27 |
| 11 | 0.27 | 0.40 |

Preparation and Evaluation of Dye-Receiver Elements

Dye-receiver elements according to the invention were prepared by first extrusion laminating a paper core with a 38μ thick microvoided composite film (OPPalyte 350TW®, Mobil Chemical Co.) as disclosed in U.S. Pat. No. 5,244,861. The composite film side of the resulting laminate was then coated with the following layers in the order recited:

1) a subbing layer of Polymin Waterfree® polyethyleneimine (BASF, 0.02 g/m$^2$), and 2) a dye-receiving layer composed of the receiver polymers 1–3 (5.23 g/m$^2$) or receiver polymers C-1 through C-5 (3.23 g/m$^2$) and a fluorocarbon surfactant (Fluorad FC-170C®, 3M Corporation, 0.022 g/m$^2$), except for control receivers C-1 and C-2 which were coated using a polysiloxane-polyether wetting agent (Silwet L-7602, Silwet Co.) (0.16 g/m$^2$). The receiver polymers 1–3 and C-1 and C-2 were coated from water. C-3 was coated from methyl ethyl ketone, C-4 was coated from a methanol/methyl ethyl ketone mixture and C-5 was coated from methanol.

Preparation and Evaluation of Thermal Dye Transfer Images

Eleven-step sensitometric thermal dye transfer images were prepared from the above dye-donor and dye-receiver elements. The dye side of the dye-donor element approximately 10 cm×15 cm in area was placed in contact with the dye image-receiving layer side of a dye-receiving element of the same area. This assemblage was clamped to a stepper motor-driven, 60 mm diameter rubber roller. A thermal head (TDK No. 8I0625, thermostatted at 31° C.) was pressed with a force of 24.4 newtons (2.5 kg) against the dye-donor element side of the assemblage, pushing it against the rubber roller.

The imaging electronics were activated causing the donor-receiver assemblage to be drawn through the printing head/roller nip at 11.1 mm/s. Coincidentally, the resistive elements in the thermal print head were pulsed (128 μs/pulse) at 129 μs intervals during a 16.9 μs/dot printing cycle. A stepped image density was generated by incrementally increasing the number of pulses/dot from a minimum of 0 to a maximum of 127 pulses/dot. The voltage supplied to the thermal head was approximately 9.25 to 12.25 v resulting in an instantaneous peak power of from 0.175 watts/dot to 0.306 watts/dot and a maximum total energy of from 2.84 mJ/dot to 4.78 mJ/dot.

After printing, each dye-donor element was separated from the imaged receiving element and placed in an oven at 50° C./50% RH for 16 hours to ensure that the dye was distributed throughout the receiving layer. After incubation, the appropriate (red, green or blue) Status A, reflection density of each of the eleven steps in the stepped-image was measured with a reflection densitometer.

The image was then placed into a light fade chamber and faded for one week at an intensity of 50,000 lux daylight. After fading the reflection density of each of the eleven steps in the stepped image was again measured with a reflection densitometer. The following results were obtained:

TABLE 2

| Dye Donor Element with Dye | Dye Receiver Polymer | Print Voltage | Initial Status A Refl. Density Status A Red | % Fade |
|---|---|---|---|---|
| 1 | 1 | 9.25 | 0.92 | 2 |
| 1 | 2 | 9.25 | 1.16 | 2 |
| 1 | C-1 | 10.25 | 1.10 | 70 |
| 1 | C-2 | 10.25 | 0.89 | 31 |
| 1 | C-3 | 10.25 | 0.99 | 59 |
| 1 | C-4 | 9.25 | 0.90 | 31 |

TABLE 3

| Dye Donor Element with Dye | Dye Receiver Polymer | Print Voltage | Initial Status A Refl. Density Status A Blue | % Fade |
|---|---|---|---|---|
| 5 | 1 | 9.25 | 1.18 | 35 |
| 5 | 2 | 9.50 | 1.08 | 38 |
| 5 | C-1 | 10.25 | 1.23 | 86 |
| 5 | C-2 | 10.25 | 1.35 | 84 |
| 5 | C-3 | 10.25 | 0.94 | 86 |
| 5 | C-4 | 9.25 | 1.06 | 84 |

TABLE 4

| Dye Donor Element with Dye | Dye Receiver Polymer | Print Voltage | Initial Status A Refl. Density Status A Red | % Fade |
|---|---|---|---|---|
| 9 | 1 | 9.25 | 1.09 | 2 |
| 9 | 2 | 9.25 | 1.13 | 4 |
| 9 | C-4 | 9.25 | 0.98 | 29 |

TABLE 5

| Dye Donor Element with Dye | Dye Receiver Polymer | Print Voltage | Initial Status A Refl. Density Status A Red | % Fade |
|---|---|---|---|---|
| 10 | 1 | 10.25 | 1.07 | 10 |
| 10 | 2 | 10.25 | 1.05 | 39 |
| 10 | C-2 | 12.25 | 1.09 | 72 |
| 10 | C-3 | 12.25 | 1.09 | 67 |
| 10 | C-4 | 10.25 | 0.80 | 84 |
| 10 | 3 | 10.25 | 0.94 | 70 |
| 10 | C-5 | 10.25 | 1.00 | 100 |

TABLE 6

| Dye Donor Element with Dye | Dye Receiver Polymer | Print Voltage | Initial Status A Refl. Density Status A Blue | % Fade |
|---|---|---|---|---|
| 11 | 1 | 10.25 | 1.05 | 23 |
| 11 | 2 | 10.25 | 0.90 | 49 |
| 11 | C-4 | 10.25 | 1.08 | 64 |
| 11 | 3 | 10.25 | 1.03 | 22 |
| 11 | C-5 | 10.25 | 0.97 | 48 |

The above data show that the light fastness of different types of transferred dyes is greatly enhanced when the polymeric materials of the invention are used in dye-receiving layers as compared to prior art control dye-receiving layers.

The invention has been described in detail with particular reference to preferred embodiments thereof, but it will be understood that variations and modifications can be effected within the spirit and scope of the invention.

What is claimed is:

1. A thermal dye transfer assemblage comprising:

(a) a dye-donor element comprising a support having thereon a dye layer comprising a dye dispersed in a polymeric binder, said dye being a cationic dye or a deprotonated cationic dye which is capable of being reprotonated to a cationic dye having a N—H group which is part of a conjugated system, and (b) a dye-receiving element comprising a support having thereon a polymeric dye image-receiving layer, said dye-receiving element being in a superposed relationship with said dye-donor element so that said dye layer is in contact with said dye image-receiving layer, said dye image-receiving layer comprising a polyester ionomer comprising a polyester backbone containing units of a sulfonic acid or a sulfonimide or their salts, with the proviso that when said dye is a deprotonated cationic dye which is capable of being reprotonated to a cationic dye having a N—H group which is part of a conjugated system, said dye image-receiving layer comprises a polyester ionomer comprising a polyester backbone containing units of a sulfonic acid or a sulfonimide.

2. The assemblage of claim 1 wherein said polyester ionomer is in a free acid form.

3. The assemblage of claim 1 wherein said polyester ionomer is in a salt form.

4. The assemblage of claim 1 wherein said polyester ionomer has the formula:

~~[A][B][D]~~ wherein:

A represents a diol component which comprises 100 mole % of recurring units derived from one or more diols having the structure $-OR_1O-$ or

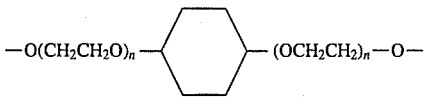

where n=1–4 and $R_1$ represents an alkylene group of 1 to about 16 carbon atoms, a cycloalkylene group of about 6 to about 20 carbon atoms, a cyclobisalkylene group of about 8 to about 20 carbon atoms, or an arylene group of about 6 to about 12 carbon atoms;

B represents an acid component which comprises 8 to 30 mole % of recurring units derived from one or more dicarboxylic acids having the structure

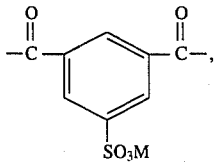

-continued

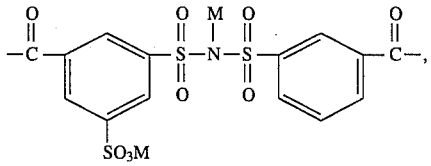

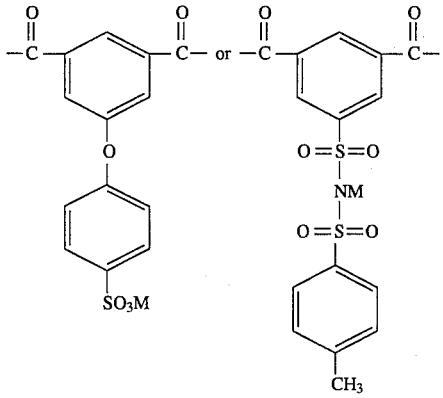

where M=H, Na, K or $NH_4$; and

D represents an acid component which comprises 70 to 92 mole % of recurring units derived from one or more dicarboxylic acids having the structure

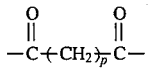

where p=2–10,

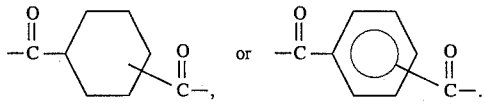

5. The assemblage of claim 1 wherein said polyester ionomer has the formula:

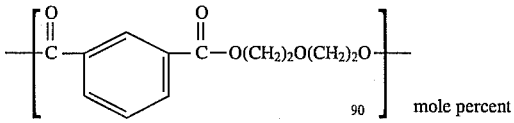

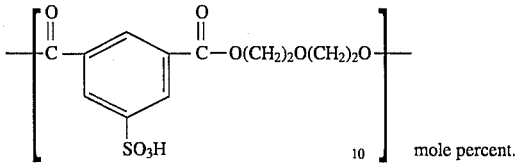

6. The assemblage of claim 1 wherein said polyester ionomer has the formula:

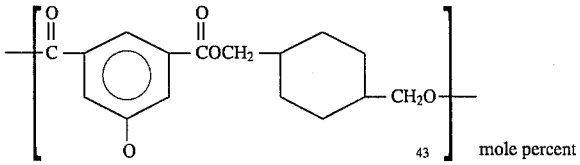

-continued

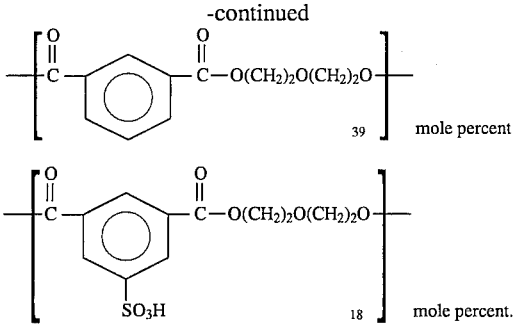

7. The assemblage of claim 1 wherein said deprotonated cationic dye has the following formula:

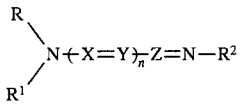

wherein:

X, Y and Z form a conjugated link between nitrogen atoms selected from CH, C-alkyl, N, or a combination thereof, the conjugated link optionally forming part of an aromatic or heterocyclic ring;

R represents a substituted or unsubstituted alkyl group from about 1 to about 10 carbon atoms;

$R^1$ and $R^2$ each individually represents substituted or unsubstituted phenyl or a substituted or unsubstituted alkyl group from about 1 to about 10 carbon atoms; and n is 0 to 11.

8. The assemblage of claim 1 wherein said cationic dye has the formula:

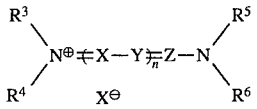

wherein:

X, Y and Z form a conjugated link between nitrogen atoms selected from CH, C-alkyl, N, or a combination thereof, the conjugated link optionally forming part of an aromatic or heterocyclic ring;

$R^3$ represents a substituted or unsubstituted alkyl group from about 1 to about 10 carbon atoms;

$R^4$, $R^5$ and $R^6$ each individually represents hydrogen, substituted or unsubstituted phenyl or a substituted or unsubstituted alkyl group from about 1 to about 10 carbon atoms;

n is 0 to 11; and $X^-$ represents Cl, $HSO_4.ZnSO_4$, $BF_4$, I, $R^7CO_2$, $R^7SO_3$, $R^7C_6H_4SO_3$ or $R^7OSO_3$, where $R^7$ represents a substituted or unsubstituted alkyl group from about 1 to about 18 carbon atoms.

9. The assemblage of claim 8 wherein said cationic dye has the formula:

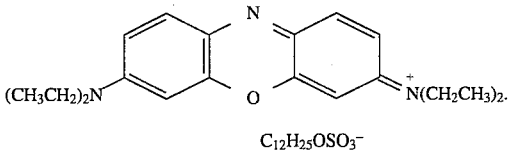

10. The assemblage of claim 8 wherein said cationic dye has the formula:

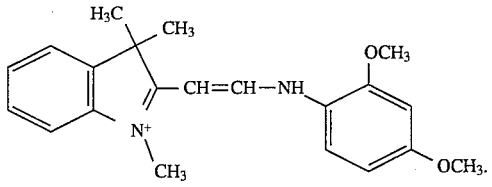

11. A process of forming a dye transfer image comprising imagewise-heating a dye-donor element comprising a support having thereon a dye layer comprising a dye dispersed in a polymeric binder, said dye being a cationic dye or a deprotonated cationic dye which is capable of being reprotonated to a cationic dye having a N—H group which is part of a conjugated system, and imagewise transferring said dye to a dye-receiving element to form said dye transfer image, said dye-receiving element comprising a support having thereon a polymeric dye image-receiving layer comprising a polyester ionomer comprising a polyester backbone containing units of a sulfonic acid or a sulfonimide or their salts, with the proviso that when said dye is a deprotonated cationic dye which is capable of being reprotonated to a cationic dye having a N—H group which is part of a conjugated system, said dye image-receiving layer comprises a polyester ionomer comprising a polyester backbone containing units of a sulfonic acid or a sulfonimide.

12. The process of claim 11 wherein said polyester ionomer is in a free acid form.

13. The process of claim 11 wherein said polyester ionomer is in a salt form.

14. The process of claim 11 wherein said polyester ionomer has the formula:

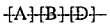

wherein:

A represents a diol component which comprises 100 mole % of recurring units derived from one or more diols having the structure

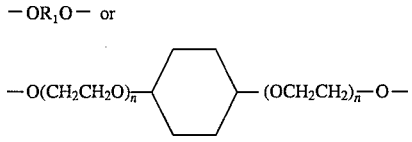

where n=1–4 and $R_1$ represents an alkylene group of 1 to about 16 carbon atoms, a cycloalkylene group of about 6 to about 20 carbon atoms, a cyclobisalkylene group of about 8 to about 20 carbon atoms, or an arylene group of about 6 to about 12 carbon atoms;

B represents an acid component which comprises 8 to 30 mole % of recurring units derived from one or more dicarboxylic acids having the structure

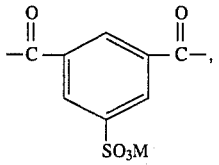

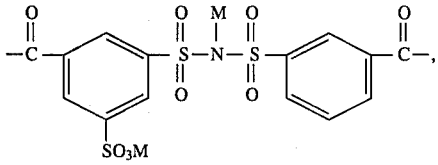

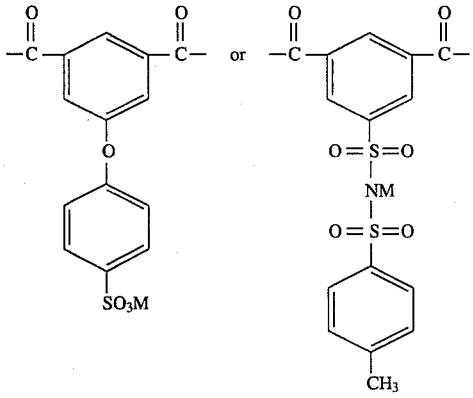

where M=H, Na, K or $NH_4$; and

D represents an acid component which comprises 70 to 92 mole % of recurring units derived from one or more dicarboxylic acids having the structure

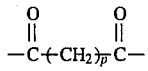

where p=2–10,

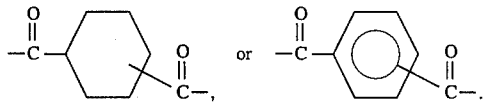

15. The process of claim 11 wherein said polyester ionomer has the formula:

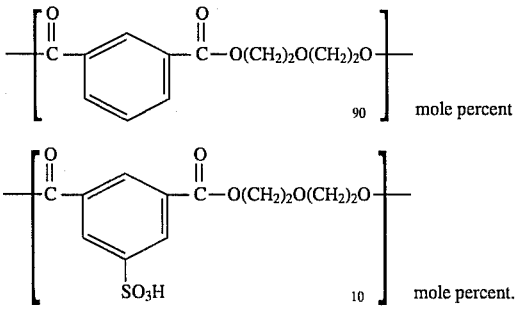

16. The process of claim 11 wherein said polyester ionomer has the formula:

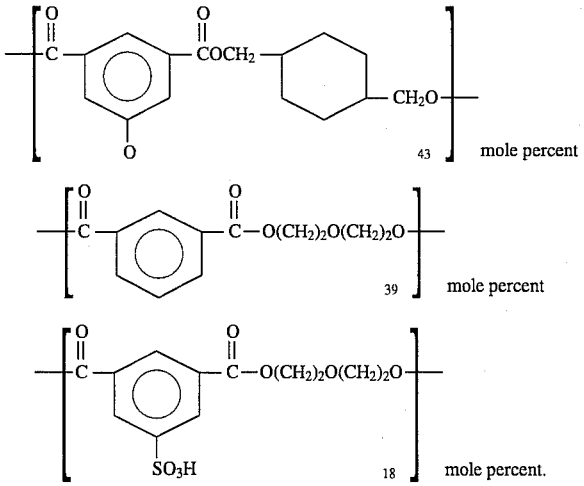

17. The process of claim 11 wherein said deprotonated cationic dye has the following formula:

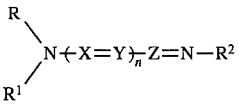

wherein:

X, Y and Z form a conjugated link between nitrogen atoms selected from CH, C-alkyl, N, or a combination thereof, the conjugated link optionally forming part of an aromatic or heterocyclic ring;

R represents a substituted or unsubstituted alkyl group from about 1 to about 10 carbon atoms;

$R^1$ and $R^2$ each individually represents substituted or unsubstituted phenyl or a substituted or unsubstituted alkyl group from about 1 to about 10 carbon atoms; and n is 0 to 11.

18. The process of claim 11 wherein said cationic dye has the formula:

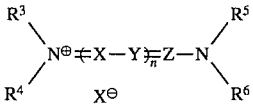

wherein:

X, Y and Z form a conjugated link between nitrogen atoms selected from CH, C-alkyl, N, or a combination thereof, the conjugated link optionally forming part of an aromatic or heterocyclic ring;

$R^3$ represents a substituted or unsubstituted alkyl group from about 1 to about 10 carbon atoms;

$R^4$, $R^5$ and $R^6$ each individually represents hydrogen, substituted or unsubstituted phenyl or a substituted or unsubstituted alkyl group from about 1 to about 10 carbon atoms;

n is 0 to 11; and $X^-$ represents Cl, $HSO_4.ZnSO_4$, $BF_4$, I, $R^7CO_2$, $R^7SO_3$, $R^7C_6H_4SO_3$ or $R^7OSO_3$, where $R^7$ represents a substituted or unsubstituted alkyl group from about 1 to about 18 carbon atoms.

19. The process of claim 18 wherein said cationic dye has the formula:
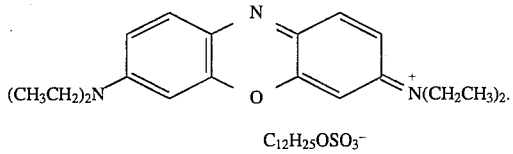
20. The process of claim 18 wherein said cationic dye has the formula:
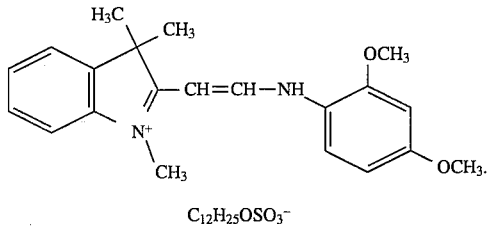
* * * * *